United States Patent [19]

Hermanson

[11] 4,015,533

[45] Apr. 5, 1977

[54] DUAL PRESSURE SENSING SAFING AND ARMING MECHANISM

[75] Inventor: Ray A. Hermanson, Minneapolis, Minn.

[73] Assignee: The United States of America as represented by the Secretary of the Air Force, Washington, D.C.

[22] Filed: June 15, 1976

[21] Appl. No.: 696,341

[52] U.S. Cl. ..... 102/81; 102/76 P

[51] Int. Cl.[2] ..... F42C 5/00

[58] Field of Search ..... 102/81, 78, 76 P, 76, 102/70 R

[56] References Cited

UNITED STATES PATENTS

| | | | |
|---|---|---|---|
| 2,030,085 | 2/1936 | Woodberry | 102/76 P |
| 2,469,352 | 5/1949 | Lauritsen | 102/81 |
| 3,532,057 | 10/1970 | Aubrey | 102/81 |
| 3,583,321 | 6/1971 | Anderson et al. | 102/81 |

*Primary Examiner*—David H. Brown
*Attorney, Agent, or Firm*—Joseph E. Rusz; Jacob N. Erlich

[57] ABSTRACT

A dual pressure sensing safing and arming mechanism having a first spring biased piston movable by a first, low fluid pressure signal to remove a first interlock on the mechanism and a second spring biased piston movable by a second, high fluid pressure signal to remove a second interlock on the mechanism. Upon the removal of the pair of interlocks an arming slider containing a detonator therein moves into operative alignment with a firing mechanism. A reverse order of the fluid pressure signals jams the first piston and arming slider thereby producing a fail safe condition.

11 Claims, 6 Drawing Figures

DUAL PRESSURE SENSING SAFING AND ARMING MECHANISM

STATEMENT OF GOVERNMENT INTEREST

The invention described herein may be manufactured and used by or for the Government for governmental purposes without the payment of any royalty thereon.

BACKGROUND OF THE INVENTION

This invention relates generally to safeing and arming fuzes or mechanisms, and, more particularly, to a mechanism which is responsive to two distinctly different pressure signals in a predetermined sequence in order for its activation to take place.

A fuze is a mechanism for igniting or detonating the bursting charge of any munition, such as a projectile, and performs this function either upon impact or at a certain time during flight. The purpose of safeing and arming fuzes is to provide safety to the personnel during the handling and storage of the fuzes while permitting placement of the munition containing the fuze in the desired position over the target area before the munition is armed. This munition is then exploded on the target by the initiation from the fuze upon impact thereof. Various ways have heretofore been employed for the prevention of pre-target detonation of these munitions during tactical deployment. Among these are fuzes utilizing highly complex electric circuitry, acceleration setback devices, centrifugal arming devices, and fuzes utilizing lanyards, propellers, anemometers, timers, etc. Most of these systems require flutes, vanes or other protuberances on the munition to activate the fuze arming sequence. Other munitions must be stabilized so that they will impact the target in a specific attitude so as to cause initiation of the explosive charge by the fuze.

Unfortunately the systems used in the past left much to the desired when it came to safety of handling, reliability of operation, miniaturization of components and the capability of being produced on high production type machinery.

SUMMARY OF THE INVENTION

The instant invention sets forth a dual pressure sensing safeing and arming mechanism which overcomes the problems set forth hereinabove by being reliably responsive to two distinctly different pressure signals. As such, the safeing and arming mechanism of this invention finds utility as a fuze for an impact-type munition, for example, or as the activating mechanism for any other type of device which has ready access to two distinct pressure signals.

The mechanism of the instant invention is in the form of a body which encloses therein activating components which are responsive to distinct pressure signals and a firing mechanism which becomes operable when a predetermined series of events take place. The events which must take place are the reception by the components of the safeing and arming mechanism of this invention of (1) a long duration, low pressure signal followed by (2) a short duration high pressure signal. Both of these signals are necessary for the arming or activation of the invention to take place. It is essential that these signals be sensed in a specific sequence in order to result in a fully armed device. If the high pressure signal is sensed first, the safeing and arming mechanism of this invention fails safe.

In operation a low pressure piston responds to a low pressure signal and in so doing removes a first interlock which allows the arming sequence to proceed. The introduction of a subsequent high pressure signal moves a high pressure piston and releases a second interlock. An arming spring is initially free of stored energy in the safe or inoperable condition, however, this spring becomes loaded when the first or low pressure signal is sensed in a proper sequence. Thereafter the loaded arming spring acts as the driving force for moving an arming slider to the fully armed or operative position.

An inertial firing mechanism is contained within the body of the safeing and arming mechanism of this invention and is restrained from movement during the initial phases of operation. Upon movement of the arming slider an inertial ball of the spring mechanism is repositioned and allows the firing mechanism to become sensitive or responsive to impact.

It is therefore an object of this invention to provide a dual pressure sensing safeing and arming mechanism which is responsive to two distinct pressure signals in a predetermined sequence for its activation.

It is another object of this invention to provide a dual pressure sensing safeing and arming mechanism which eliminates the need for electrical circuitry in its construction.

It is a further object of this invention to provide a dual pressure sensing safeing and arming mechanism which is extremely reliable in operation and rugged in construction.

It is a still further object of this invention to provide a dual pressure sensing safeing and arming mechanism which is economical to produce and which utilizes conventional, currently available components that lend themselves to standard mass producing manufacturing techniques.

For a better understanding of the present invention together with other and further objects thereof reference is made to the following description taken in conjunction with the accompanying drawing and its scope will be pointed out in the appended claims.

DETAILED DESCRIPTION OF THE PREFERRED EMBODIMENT

Figure 1:
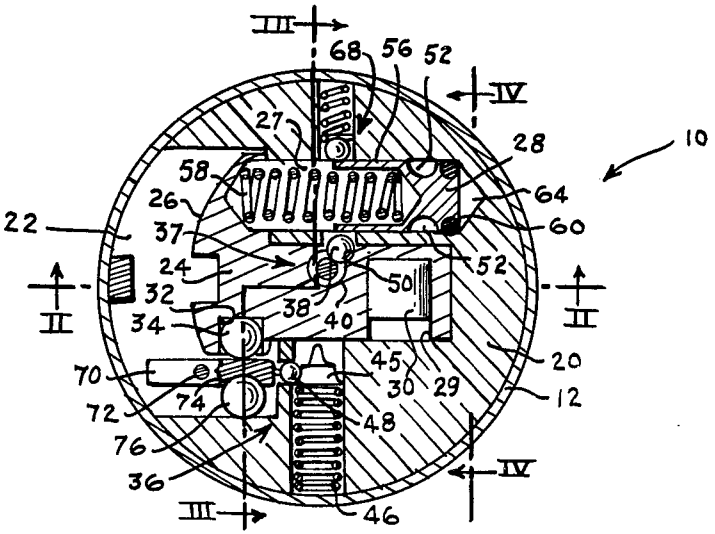
FIG. 1 is a plan view of the dual pressure sensing safeing and arming mechanism of this invention shown partly in cross section and in the inactive position.
Figure 2:
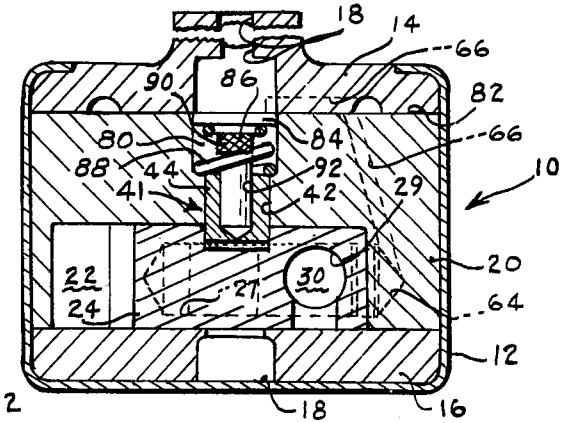
FIG. 2 is a side elevational view taken along line II—II of FIG. 1 of the dual pressure sensing safeing and arming mechanism of this invention shown partly in cross section and in the inactive position.

Reference is now made to FIGS. 1 and 2 of the drawing which best show the details of the dual pressure sensing safeing and arming mechanism 10 of this invention. Mechanism 10 is preferably of a cylindrical configuration made of any suitable material such as metal, having an outer housing 12 and a cover 14. Located with housing 12 and on the bottom thereof is a base 16 containing therein a centrally located detonator output 18 which can be operatively connected to any suitable munition (not shown) or any other device to be utilized with the safeing and arming mechanism 10 of this invention. Located within housing 12 and juxtaposed base 16 is body 20. Body 20 has a cavity 22 located therein which contains the various components of the instant invention.

Figure 3:
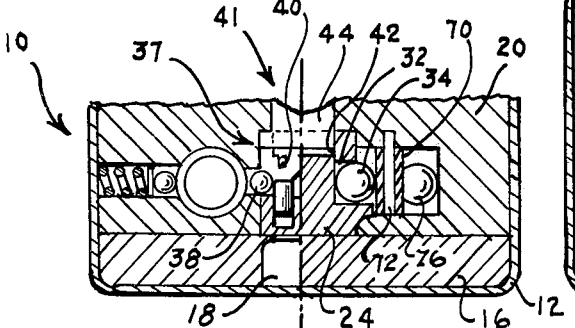
FIG. 3 is a fragmented side elevational view taken along line III—III of FIG. 1 of the dual pressure sensing safeing and arming mechanism of this invention shown partly in cross section and in the inactive position.

Cavity 22 encloses the essential components of safeing and arming mechanism 10. An arming slider 24 is slidably mounted within cavity 22 of body 20. Slider 24 is of a substantially rectangular configuration having an extension 26 formed as an integral part of one end thereof. Extension 26 forms one end of a chamber 27 for a low pressure piston 28 to be described in detail hereinbelow. In addition, slider 24 contains, at the other end thereof, an opening 29 which encompasses a detonator 30. Also located within slider 24 is an indentation 32 which contains therein a ball 34 of the inertial firing mechanism 36 to be described in detail hereinbelow. A first safeing interlock 37 made up of a locking ball 38 and plunger 40 is located in interlocking relationship with piston 28, body 20, slider 24 and a second interlock 41 (shown in FIGS. 2 and 3). As shown in FIG. 2 and 3 of the drawing a slot 42 within slider 24 contains slider lock 44 of second interlock 41, the function of which will be explained in detail hereinbelow. Located adjacent to and perpendicular to slider 24 (shown in FIG. 1) is firing pin 45 and firing pin spring 46 of firing mechanism 36. Firing pin 45 is held in a retracted or non-operative position by ball 48 of firing mechanism 36.

In the inoperative or inactive position as shown in FIGS. 1–3 of the drawing, firing pin 45 is out of alignment with detonator 30 and slider 24 is held in this inoperative position by means of first interlock 37 having locking ball 38 engage a recess 50 within slider 24 while abutting housing 20 and second interlock 41 having slider lock 44 engage slot 42.

Figure 4:
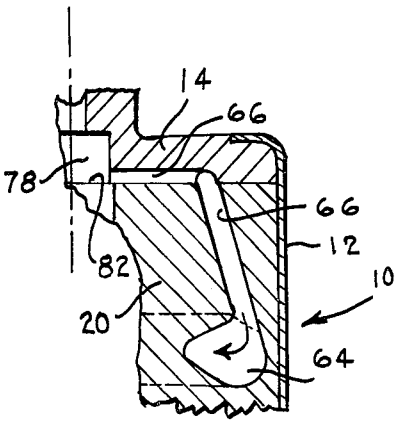
FIG. 4 is a fragmented side elevational view taken along line IV—IV of FIG. 1 of the dual pressure sensing and arming mechanism of this invention shown partly in cross section.

The low pressure piston 28 has a circumferential groove 52 therein as well as an outer extension 56 for housing therein, in combination with extension 26, an arming spring 58. In its non-compressed state spring 58 rests between extension 26 of slider 24 and the interior of piston 28. Piston 28 utilizes an O-ring seal 60 to faciliate its sliding movement within chamber 27 of body 20. A cavity 64 (shown in FIGS. 1 and 4 of the drawing) receives low pressure fluid from any suitable source by way of fluid inlet 66 in a manner to be described in detail hereinbelow. Also located within body 20 and adjacent piston 28 is a spring bias locking ball assembly 68 and previously described locking ball 38. Firing mechanism 36 located adjacent slider 24 further comprises a lever 70 pivotally mounted within body 20 by any suitable pivotable connecting rod 72. Conical indentation 74 within lever 70 accepts an inertia ball while inertia ball 34 rests within indentation 32 and upon lever 70.

Located within cover 14 of safeing and arming mechanism 10 is an inlet 78 which is capable of receiving high and low pressure signals for the activation of the safeing and arming mechanism 10 of this invention. In addition to inlet 78 interposed between inlet 78 and chamber 80 within body 20 is any suitable seal 82 made of any rupturable material such as aluminum. Within chamber 80 is slidably mounted a high pressure piston 84 having a lock stem 86 associated therewith and lock spring 88. Lock stem 86 has a knurled portion 90 thereon which is capable of engaging and fixedly securing stem 86 within a slot 92 located in slider lock 44.

Still referring to FIGS. 1–4 of the drawing, in the safe condition slider 24 is locked in the out-of-line position by the combination of the first and second interlocks 37 and 41, respectfully. The sequence of arming or activation of this invention begins with the introduction from any suitable pressure source (not shown) of a low pressure arming signal through inlet 78. The low pressure signal is directed from inlet 78 through passageway 66 and into chamber 64.

Figure 5:
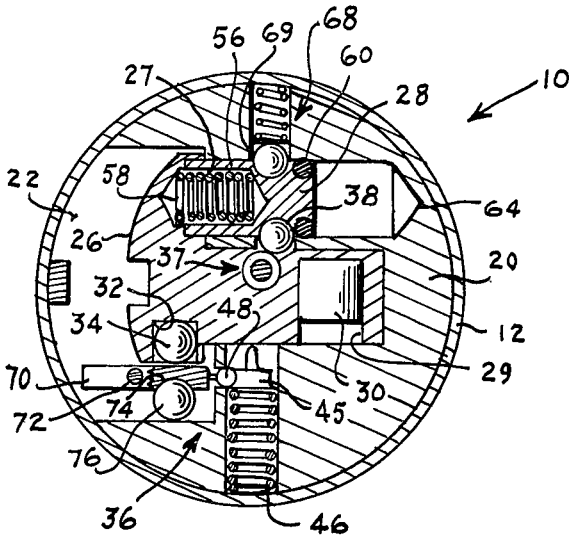
FIG. 5 is a plan view of the dual pressure sensing safeing and arming mechanism of this invention shown partly in cross section and with the first interlock removed.

This low pressure signal of approximately 30psig is sufficient to overcome the strength of spring 58 thereby causing the movement of piston 28 with respect to slider 24 and thereby loading or compressing spring 58. With spring 58 in the compressed position piston 28, (shown in FIG. 5 of the drawing) ball 69 of ball assembly 68 and ball 38 of first interlock 37 mates with groove 52, respectively, thereby securely locking piston 28 in the position shown in FIG. 5 of the drawing. With ball 38 now located within groove 52 of piston 28, ball 38 no longer acts as a deterent against the subsequent movement of slider 24. Thus, the first safety interlock 37 is now removed.

The subsequent introduction of a high pressure arming signal through inlet 78 of sufficient pressure to rupture seal 82 acts against high pressure piston 84 and in opposition to lock spring 88. This pressure will force high pressure piston 84 downwardly driving stem 86 into slot 92 within slider lock 44. The knurled portion 99 of stem 86 fixedly secures stem 86 to slider lock 44 and on the subsequent reduction of pressure, spring 88 forces slider lock 44 upward and out of engagement with slot 42 within slider 24 thereby removing the second safety interlock 41.

Figure 6:
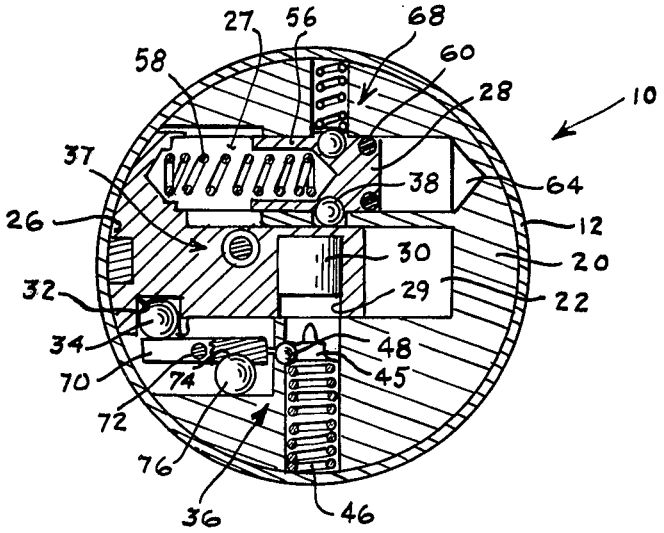
FIG. 6 is a plan view of the dual pressure sensing safeing and arming mechanism of this invention shown partly in cross section, with the second interlock removed and in the activated or armed position.

With both safety interlocks 37 and 41 now removed, compressed spring 58 acts upon extension 26 of slider 24 moving slider 24 into the completely operative or activated position as shown in FIG. 6 of the drawing. Once in this position ball 34 of inertial firing mechanism 36 is moved with respect to lever 70 and ball 76, thereby leaving mechanism 36 in the unbalanced position. Upon impact of the safeing and arming mechanism 10 of this invention, lever 70 pivots about pivot point 72 thereby releasing ball 48 and allowing firing pin 45 to strike detonator 30 causing the detonation in a conventional manner of any suitable munition associated with the instant invention.

It is essential for the activation of operation of safeing and arming mechanism 10 to take place, that the input signals be sensed in a proper low-high sequence. If the high pressure is sensed first, passageway 66 constitutes a sufficient time delay so that high pressure piston 84 will be depressed before movement of piston 28. Without the removal of locking ball 38, the depression of high pressure piston 84 and stem 86, slider lock 44 will be forced against plunger 40 (FIG. 3) thereby nonreversibly jamming ball 38 between low pressure piston 28, body 20 and slider 24. Such positioning will prevent any further movement of either low pressure piston 28 or slider 24 no matter what subsequent pressure signals are given to the safeing and arming mechanism 10 of this invention.

Although this invention has been described with reference to a particular embodiment it will be understood to those skilled in the art that this invention is also capable of a variety of other embodiments within the spirit and scope of the appended claims.

I claim:

1. A dual pressure sensing safeing and arming mechanism comprising a housing, said housing containing therein a detonator, means for moving said detonator from an inoperable to an operable position, first means for preventing the movement of said detonator moving means, second means for preventing the movement of said detonator moving means, means operably connected to said first movement preventing means for releasing said first movement preventing means upon the application of a first predetermined pressure signal, means operably connected to said second movement preventing means for releasing said second movement preventing means upon the application and subsequent reduction of a second predetermined pressure signal and a firing mechanism in operative relationship with said detonator when said detonator is in the operable position whereby upon the application in a predetermined sequence of said first and second pressure signals, said first movement prevention means is released and said second movement prevention means is released thereby allowing said detonator to be moved to the operative position.

2. A dual pressure sensing safeing and arming mechanism as defined in claim 1 further comprising means operatively connected to said first movement prevention means for permanently preventing the movement of said means for moving said detonator under preselected conditions.

3. A dual pressure sensing safeing and arming mechanism as defined in claim 2 wherein said means for moving said detonator comprises an arming slider, said arming slider containing said detonator therein and being operably connected to said firing mechanism.

4. A dual pressure sensing safeing and arming mechanism as defined in claim 3 wherein said first movement prevention means comprises a ball operatively interconnected between said means for releasing said first movement prevention means and said arming slider.

5. A dual pressure sensing safeing and arming mechanism as defined in claim 4 wherein said second movement prevention means comprises a lock slider operatively connected between said means for releasing said second movement prevention means and said arming slider.

6. A dual pressure sensing safeing and arming mechanism as defined in claim 5 wherein said means for permanently preventing the movement of said slider comprises a plunger, said plunger being operatively connected between said ball, said lock slider and said arming slider.

7. A dual pressure sensing safeing and arming mechanism as defined in claim 6 wherein said arming slider comprises an elongated element having an extension thereon, said extension being in operative relationship with said means for releasing said first movement prevention means.

8. A dual pressure sensing safeing and arming mechanism as defined in claim 7 wherein said means for releasing said first movement prevention means comprises a piston and a spring, said spring being interposed between said extension on said arming slider and said piston and an indentation located within said piston for receiving said ball.

9. A dual pressure sensing safeing and arming mechanism as defined in claim 8 wherein said means for releasing said second movement prevention means comprises a piston having a knurled stem thereon and a spring surrounding said stem.

10. A dual pressure sensing safeing and arming mechanism as defined in claim 9 wherein said lock slider has a slot therein, said slot in operative alignment with said stem of said means for releasing said second movement prevention means.

11. A dual pressure sensing safeing and arming mechanism as defined in claim 10 wherein said firing mechanism comprises a firing pin in operative alignment with said detonator when said detonator is in the operable position, a lever pivotally mounted within said housing, said lever being operatively connected to said firing pin and a pair of inertial balls located on opposite sides of said lever, one of said balls being operatively connected to said arming slider for movement therewith.

* * * * *